US007651419B2

(12) United States Patent
Brunner

(10) Patent No.: US 7,651,419 B2
(45) Date of Patent: Jan. 26, 2010

(54) HANDLE PROVIDING SHOCK ABSORPTION

(76) Inventor: Adolf Brunner, Ennsweg 35, A-5550 Radstadt (AT)

( * ) Notice: Subject to any disclaimer, the term of this patent is extended or adjusted under 35 U.S.C. 154(b) by 421 days.

(21) Appl. No.: 11/804,280

(22) Filed: May 16, 2007

(65) Prior Publication Data

US 2007/0275797 A1 Nov. 29, 2007

(30) Foreign Application Priority Data

May 16, 2006 (EP) ..... 06010026

(51) Int. Cl.
*A63B 49/08* (2006.01)

(52) U.S. Cl. ..... 473/523; 473/549

(58) Field of Classification Search ..... 473/520, 473/521, 523, 549, 559, 564, 568; 16/110.1, 16/421, 430, 431
See application file for complete search history.

(56) References Cited

U.S. PATENT DOCUMENTS 2,697,642 A * 12/1954 Rudy ..... 403/410
5,355,552 A 10/1994 Huang et al.
5,795,242 A * 8/1998 Ree ..... 473/303
5,846,145 A 12/1998 Tinlin et al.
6,739,021 B2 * 5/2004 Rabello ..... 16/430
6,974,397 B2 * 12/2005 Lammer ..... 473/521
2003/0163896 A1 * 9/2003 Rabello ..... 16/110.1
2007/0275797 A1 * 11/2007 Brunner ..... 473/538

FOREIGN PATENT DOCUMENTS

DE G9309648.8 11/1993
EP 0519312 A1 12/1992
EP 0898988 A2 3/1999
JP 7-231952 9/1995

OTHER PUBLICATIONS

European Search Report for Priority Application EP 06010026.

* cited by examiner

*Primary Examiner*—Raleigh W. Chiu
(74) *Attorney, Agent, or Firm*—Byrne Poh LLP

(57) ABSTRACT

Handles providing shock absorption are provided. In some embodiments, handles comprise: a handle core having an axis; core permanent magnets mounted to the handle core; a handle sleeve surrounding the handle core; sleeve permanent magnets mounted to the handle sleeve which generate repelling forces radial to the axis from at least some of the core permanent magnets; and an adjustment screw used to control a force longitudinal to the axis.

3 Claims, 1 Drawing Sheet

Drawing A turned against drawing B, 90 degree

HANDLE PROVIDING SHOCK ABSORPTION

CROSS REFERENCE TO RELATED APPLICATION

This application claims the priority under 35 U.S.C. § 119 to European Patent Application No. EP06010026, filed May 16, 2006, which is hereby incorporated by reference herein in its entirety.

TECHNICAL FIELD

The disclosed subject matter relates to handles providing shock absorption.

BACKGROUND

Sports involving the use of rackets (e.g., such as tennis, racket ball, squash, badminton, etc.), clubs (e.g., such as golf, etc.), bats (e.g., such as baseball, cricket, etc.), sticks (e.g., hockey, lacrosse, etc.), and other similar devices are widely practiced around the world. When used, these devices frequently impact a ball, shuttlecock, puck, or other item, resulting in sharp vibration and impact forces to the users hands and arms. These forces can irritate or injure the user.

SUMMARY

Handles providing shock absorption are provided. In some embodiments, handles comprise: a handle core having an axis; core permanent magnets mounted to the handle core; a handle sleeve surrounding the handle core; sleeve permanent magnets mounted to the handle sleeve which generate repelling forces radial to the axis from at least some of the core permanent magnets; and an adjustment screw used to control a force longitudinal to the axis.

DETAILED DESCRIPTION

Figure 1:
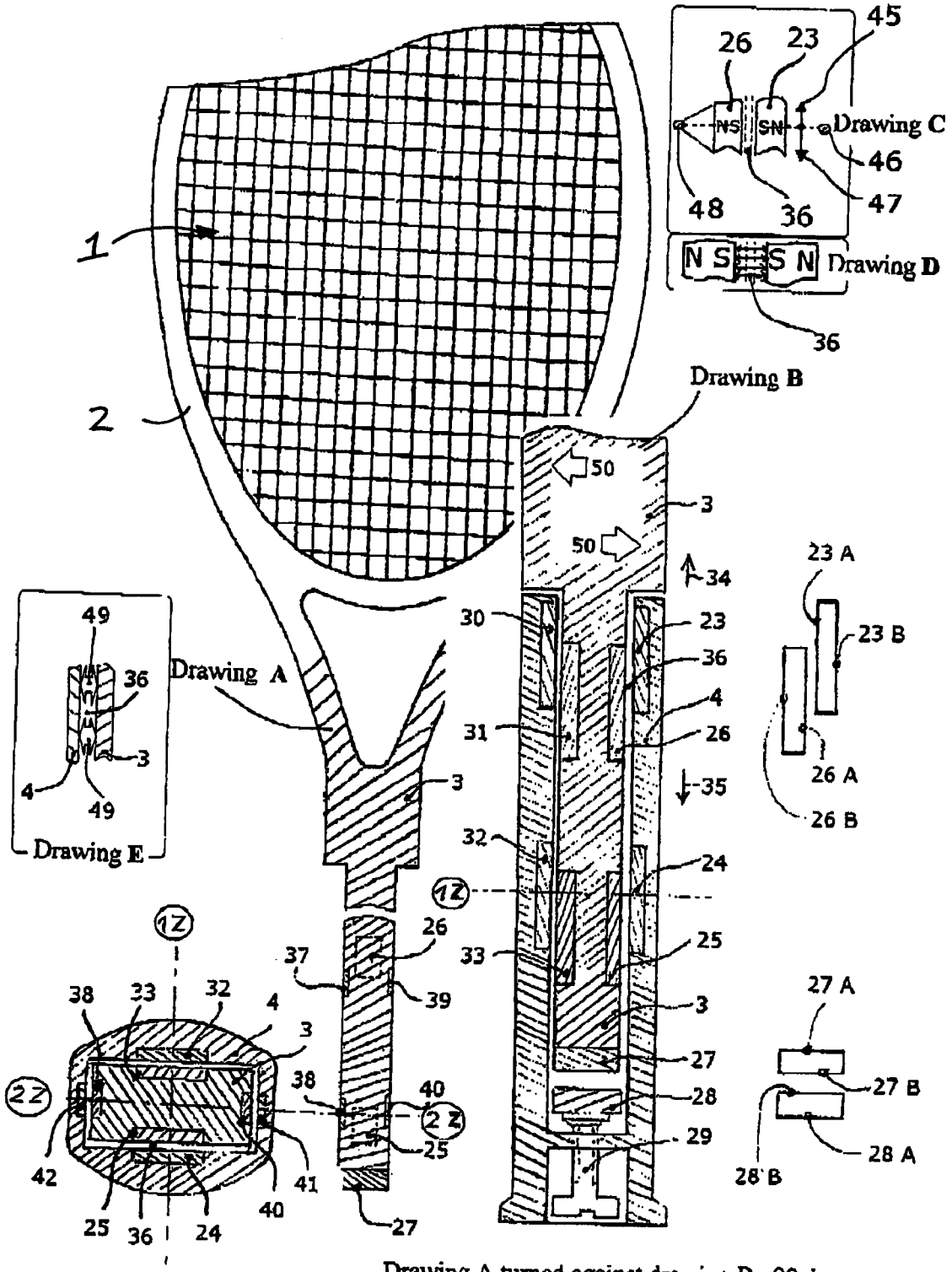
FIG. 1 is a cross-sectional diagram of different views of a handle in accordance with some embodiments.

Handles providing shock absorption are provided. In some embodiments, these handles have magnetic fields generated therein by permanent magnets to dampen the shock when using a racket, club, bat, etc. on which the handles are located. While the handles are described below in connection with a tennis racket, it should be apparent that these handles can be used on any type of device, including those for other sports, those for tools (e.g., hammers, pneumatic wrenches, etc.), and any other handle that transfers shock or vibration to a user's hands.

FIG. 1 shows a handle 3 of a tennis racquet comprising a handle sleeve 4 having a hollow space 4 in which contact-free permanent magnets are located which are poled such that repelling magnetic fields are created. Vibrations are absorbed by the non-contacting state of the magnets and the floating state of the generated magnetic fields. The strength of the magnetic field can be regulated by means of the adjustment screw 29.

FIG. 1 further explains in detail the handle design comprising magnets situated in the handle sleeve 4. Pole 27B of magnet 27 versus pole 28B of magnet 28 generates a floating state by homo-polarity between the handle 3 and the handle implement sleeve 4. From the start, the sleeve 4 is pressed so much over magnet positions 46 and 48 that the repelling magnetic fields 36 press the sleeve 4 so far in the direction 45 with the magnets 23, 24, 30, and 31 until the counter-pressure between magnets 27 and 28 is built up in an equalizing manner via the magnetic fields from poles 27B and 28B and the counter-pressure at the end face is built up at the same time, as Drawing B shows. The handle sleeve 4 with the magnets 24 and 25 and magnets 30 and 31 is moved in the direction 35 by the regulation of the adjustment screw 29 with the magnet 28 upwardly to the magnet 27 so that the magnet systems approach the strongest floating force between two positions 46 and 48 from the standing position 45 in the direction 47, so that a contact-free regulation of the floating force 36 is present between the sleeve 4 and the handle part 3.

In response to further adjustment of the sleeve 4 by means of screw 29 in the direction 35 over the highest magnetic force between two points 46 and 48 in direction 47 has taken place, the sleeve 4 leaves the floating state in the direction 35, whereby the sleeve 4 can be released from the handle 3 and can be replaced. The magnet arrangements 38 and 42 and 40 and 41 in axis 2Z, and magnets 37 and 39 serve the lateral guidance of the handle 3 in the sleeve 4, and act against one another to ensure the floating state in all directions. Main force magnetic combinations 23 and 24, 25 and 26, 30 and 31, and 32 and 33 are attached in the main ball hitting directions 50. Further vibration damping combinations are possible by combinations of springs 49 and different present magnetic arrangements.

All magnet arrangements are attached, as in sketch D, in repelling manner so that, for example, pole 23A of magnet 23 and pole 26A of magnet 26 are opposed to one another in a homo-polar manner and repel. This repelling force, which acts oppositely to the force created by magnets 30 and 31 (which have the same polar arrangement), results in a floating state due to the force of the magnetic fields with the same magnetic field strengths of the magnets of the handle 3 and the sleeve 4. These forces absorb vibrations during the course of a game in which the racket is used.

The following reference numerals are used throughout the figures. 1—racket strings; 2—racket frame; 3—racket handle; 4—racket handle sleeve; 23, 24, 25, 26, 27, 28, 30, 31, 32, 33—permanent magnets; 23A, 26A, 27B, 28B—south pole representations; 23B, 26B, 27A, 28A—north pole representations; 27, 28—necessarily round magnets; 29—adjustment/regulation screw for damping strength in direction 34 or 35; 34—direction of movement of handle sleeve 4 for weaker damping density 36 when 3 and 4 are positioned as shown in Drawing B; 35—direction of movement of handle sleeve 4 for stronger damping density 36 when 3 and 4 are positioned as shown in Drawing B; 36—magnet field density is the magnetic pressure strength between similar magnetic poles (i.e., south and south, or north and north) and/or clearance for spring systems 49; 37, 38, 39, 40—permanent magnets for lateral guidance of sleeve 4 to handle 3; 41, 42—counter-magnet to 38 and 40 for lateral guidance for 3 to 4; 43, 44—counter-magnets to magnets 37 and 39; 45—direction of movement of the handle 4 and the magnets 23, 24, 30, 32 when the handle sleeve 4 is positioned on handle 3 as shown in Drawing B up to the counter-pressure of the magnets 27, 28; 46—position of the highest mutual magnetic force on 48 (maximum floating force between all magnetic systems in the handle 3 to the handle sleeve 4); 47, 35—direction of movement of the magnets 23, 24, 30, 32 for handle replacement and the mutual magnet field strength change over 27, 28 and 29; 48—fixed positions of the magnets 25, 26, 31, 33, on handle 3; 49—spring systems of all types; and 50—main stroke execution direction.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

What is claimed is:

1. A handle comprising:

a handle core having an axis;

core permanent magnets mounted to the handle core;

a handle sleeve surrounding the handle core;

sleeve permanent magnets mounted to the handle sleeve which generate repelling forces radial to the axis from at least some of the core permanent magnets; and an adjustment screw used to control a force longitudinal to the axis.

2. The handle of claim 1, wherein the handle is incorporated into a tennis racket.

3. The handle of claim 1, wherein the adjustment screw has a screw permanent magnet attached thereto which creates a repelling force with respect to a core permanent magnet.

* * * * *